US007337609B2

(12) United States Patent
Mahnken et al.

(10) Patent No.: US 7,337,609 B2
(45) Date of Patent: Mar. 4, 2008

(54) DIESEL EXHAUST SYSTEM VARIABLE BACKPRESSURE MUFFLER

(75) Inventors: Brian W. Mahnken, Pinckney, MI (US); Santiago Santurtun, Toluca (MX); Jeffrey M. Park, Farmington Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/382,772

(22) Filed: May 11, 2006

(65) Prior Publication Data

US 2007/0261395 A1 Nov. 15, 2007

(51) Int. Cl.
*F01N 3/00* (2006.01)

(52) U.S. Cl. ..... 60/297; 60/274; 60/287; 60/292; 60/295; 60/322; 60/324; 181/237; 181/254

(58) Field of Classification Search ..... 60/274, 60/287, 288, 291, 292, 295, 297, 322, 324; 181/237, 253, 254, 268
See application file for complete search history.

(56) References Cited

U.S. PATENT DOCUMENTS

| | | | | |
|---|---|---|---|---|
| 4,264,344 | A * | 4/1981 | Ludecke et al. | 55/313 |
| 4,677,823 | A * | 7/1987 | Hardy | 60/274 |
| 4,916,897 | A * | 4/1990 | Hayashi et al. | 60/286 |
| 5,357,755 | A * | 10/1994 | Gillingham et al. | 60/288 |
| 6,588,203 | B2 * | 7/2003 | Hirota et al. | 60/297 |
| 6,739,579 | B1 * | 5/2004 | Rim | 251/306 |

* cited by examiner

*Primary Examiner*—Binh Q. Tran

(57) ABSTRACT

The invention concerns diesel particulate filter regeneration in an exhaust system of a vehicle having a diesel engine. The particulate filter regeneration is selectively accomplished by actuating a particulate filter backpressure valve located downstream of the diesel particulate filter. Exhaust noise is attenuated for both normal driving and regeneration modes of operation by directing the exhaust flow through different flow paths in a muffler downstream of the diesel particulate filter.

17 Claims, 3 Drawing Sheets

DIESEL EXHAUST SYSTEM VARIABLE BACKPRESSURE MUFFLER

BACKGROUND OF INVENTION

The present invention relates generally to an exhaust system in a vehicle having a diesel engine.

Recent emissions regulations for vehicles employing diesel engines limit the amount of soot that the vehicles may emit. The soot is produced as a by-product of the combustion of the diesel fuel and is emitted with the vehicle exhaust. Diesel particulate filters (also called traps) added to the exhaust system limit the soot emissions sufficiently to meet the regulations.

Diesel particulate filters work by collecting the soot while allowing the exhaust gasses to pass through. As the vehicle operates, then, the soot builds up in the filter. This soot needs to be periodically eliminated from the filter in order to assure that the filter does not become clogged. A clogged filter can potentially cause damage to itself or the engine.

The particulate matter that builds up in the filter can be removed through a process called regeneration. Regeneration is performed by heating the diesel particulate filter to a temperature where the soot will burn away, thus cleaning out the filter. There are two general types of regeneration—active regeneration and passive regeneration. Passive regeneration occurs under vehicle operating conditions where the temperature in the diesel particulate filter will inherently rise sufficiently (from energy already in the exhaust gas stream) to burn away some of the soot. This is advantageous in that no extra energy input is needed for the regeneration process to occur. However, while passive regeneration is desirable, it cannot be counted on to sufficiently burn away the soot under all vehicle operating conditions. For example, passive regeneration may not occur at cold ambient temperatures or under certain driving conditions, such as extended idle or city driving.

Thus, active regeneration may be employed to assure that sufficient amounts of soot are burned away in the diesel particulate filter. Active regeneration may be accomplished by an electric or other type of heater located adjacent to or within the diesel particulate filter that is activated to raise the temperature sufficiently to burn the soot away. This type of regeneration requires extra hardware near the filter as well as an energy source and controls for operating such a heater.

Another type of active regeneration is where the exhaust stream is enriched with fuel by either late in-cylinder fuel injection or by direct injection of fuel into the exhaust stream. This fuel in the exhaust stream, as it burns, raises the temperature of the exhaust gas stream—and hence the diesel particulate filter—sufficiently to cause the regeneration process to occur. While this type of active regeneration eliminates the need for extra heater hardware near the filter, it does require extra energy input (extra fuel) to be used in order to accomplish the regeneration process. Moreover, this type of regeneration has the affect of raising tailpipe exhaust gas exit temperatures much higher than is typically experienced under normal operating conditions. These temperatures may possibly rise to a level that is environmentally undesirable.

Also, for vehicles with the added diesel particulate filter, the filter regeneration mode of engine operation may create noise in the exhaust that is different or louder than that produced during the normal mode of engine operation. Consequently, a conventional muffler may have reduced effectiveness in reducing unwanted noise emissions from the exhaust system during both the normal vehicle mode of operation and during the regeneration mode of operation.

It is desirable, therefore, to provide an exhaust system employing a diesel particulate filter with a means for adequately cleaning out the filter while minimizing the amount of additional energy input, minimizing the amount and cost of extra hardware needed to achieve the filter regeneration, minimizing the increase in tailpipe exhaust gas exit temperatures during regeneration, minimizing exhaust gas backpressure during a normal mode of operation, and reducing unwanted noise emissions from the exhaust system for both the normal and regeneration modes of operation.

SUMMARY OF INVENTION

An embodiment of the present invention contemplates an exhaust system for a vehicle having a diesel engine. The exhaust system comprises a diesel particulate filter having an upstream end for receiving exhaust gasses and a downstream end for exiting the exhaust gasses; an intermediate pipe, operatively engaging the downstream end of the diesel particulate filter, having a main flow portion and a restricted flow portion, with the main flow portion including a particulate filter backpressure valve controllable to selectively restrict flow of the exhaust gasses in the main flow portion, and the restricted flow portion including a restriction; and a muffler, operatively engaging the intermediate pipe for selectively receiving the flow of the exhaust gasses from the main flow portion and the restricted flow portion.

An embodiment of the present invention contemplates a method of regenerating a diesel particulate filter in an exhaust system of a vehicle having a diesel engine, the method comprising the steps of: operating the diesel engine and exhaust system in a normal operating mode; maintaining an open particulate filter backpressure valve during normal operating mode to allow a flow of exhaust gasses through a first exhaust flow path of a muffler; monitoring at least one parameter indicative of particulate matter build-up in the diesel particulate filter while operating in the normal operating mode; determining from the at least one parameter when the diesel particulate filter needs regeneration; detecting that an exhaust backpressure is needed to induce the regeneration of the diesel particulate filter; and operating the exhaust system in a regeneration mode, if the diesel particulate filter needs regeneration and the exhaust backpressure is needed to induce the regeneration of the diesel particulate filter, by closing the particulate filter backpressure valve to redirect the flow of the exhaust gasses through a second flow path of the muffler that includes a flow restriction.

An embodiment of the present invention contemplates a muffler and pipe assembly for a vehicle having a diesel engine. The muffler and pipe assembly comprises an intermediate pipe having a main flow portion and a restricted flow portion, with the main flow portion including a particulate filter backpressure valve controllable to selectively restrict flow of exhaust gasses in the main flow portion, and the restricted flow portion including a restriction; and a muffler, operatively engaging the intermediate pipe, including a first exhaust flow path and a second exhaust flow path, wherein the particulate filter backpressure valve in an open position allows for the flow of the exhaust gasses through the first exhaust flow path, and the particulate filter backpressure valve in a closed position directs the flow of the exhaust gasses through the restriction and the second exhaust flow path.

An advantage of an embodiment of the present invention is that the particulate filter backpressure valve can be closed, creating more engine load, which in turn creates more exhaust heat. The increase in exhaust heat, then, enables regeneration to take place, even under vehicle operating and ambient conditions where it might not otherwise occur. The regeneration can, consequently, be accomplished without adding a separate particulate filter heater and minimizing extra fuel injected into the exhaust stream. So, regeneration can occur when needed in order to assure that the particulate filter does not become clogged, even under vehicle and engine operating conditions that are not conducive to causing regeneration.

An advantage of an embodiment of the present invention that the exhaust noise is attenuated and optimized for both the normal mode of driving (with an open backpressure valve) and the regeneration mode of operation (with a closed backpressure valve). This is accomplished while minimizing the increase in backpressure in the normal mode of driving.

An advantage of an embodiment of the present invention is that sufficient backpressure is created to cause regeneration in the diesel particulate trap, while minimizing any increase in the temperature of the exhaust gasses as they exit the tailpipe.

DETAILED DESCRIPTION

Figure 1:
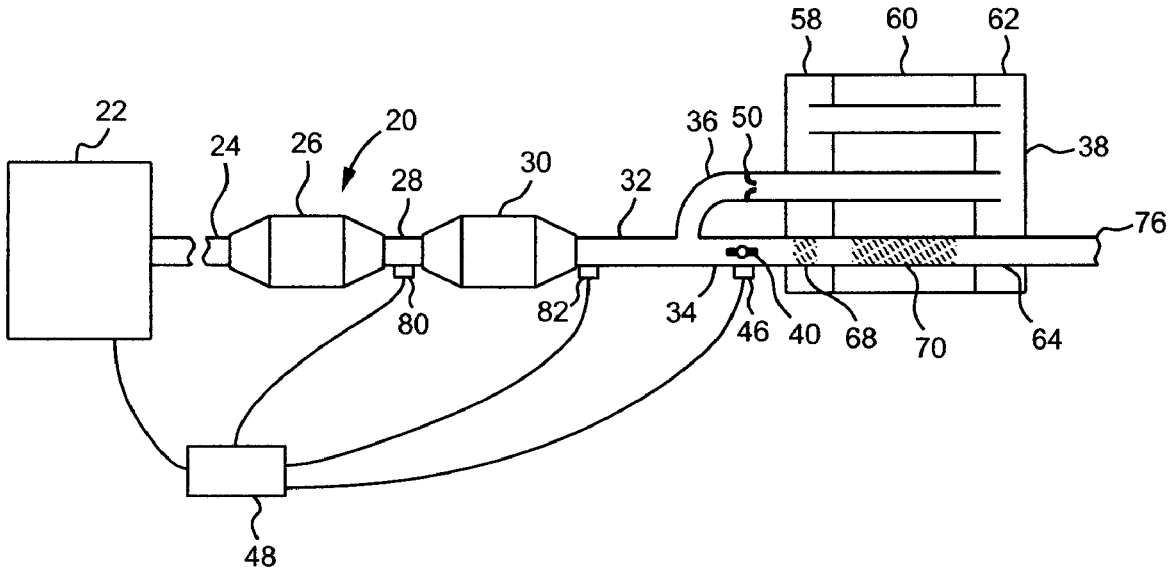
FIG. 1 is a schematic illustration of a portion of an exhaust system for a vehicle having a diesel engine, in accordance with the present invention.
Figure 2:
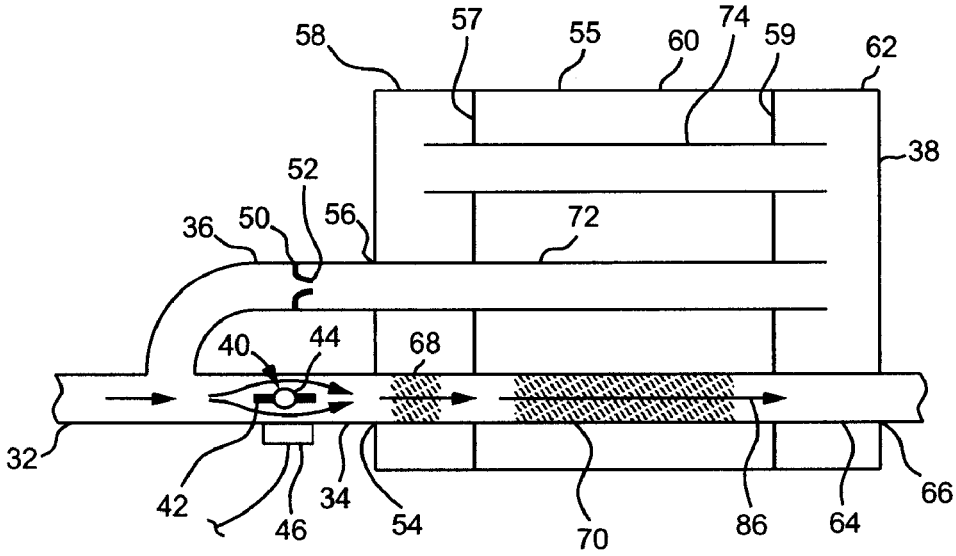
FIG. 2 is an enlarged view of a portion of the schematic drawing of FIG. 1, showing an exhaust flow path for a valve open position.
Figure 3:
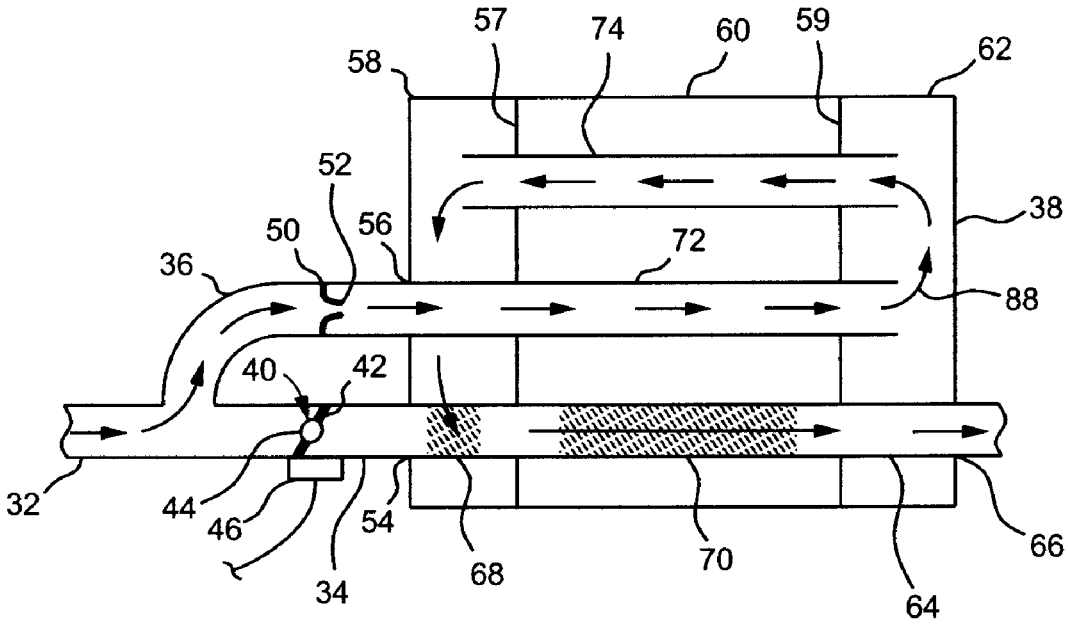
FIG. 3 is a view similar to FIG. 2, but showing an exhaust flow path for a valve closed position.

FIGS. 1-3 illustrate an exhaust system 20 that receives exhaust gasses from a diesel engine 22, treats the exhaust gasses, and directs them into the atmosphere away from the vehicle. More specifically, the exhaust system 20 includes an exhaust pipe 24—downstream of the engine 22—which directs the exhaust gases into a diesel oxidation converter 26 (also known as a diesel oxidation catalyst). The diesel oxidation converter 26 treats the exhaust gasses in order to reduce the amounts of certain constituents that will be emitted into the atmosphere. Such constituents may be, for example, carbon monoxide (CO) and unburned hydrocarbons (HC).

A first intermediate pipe 28 connects to the downstream end of the diesel oxidation converter 26 and directs the exhaust gasses into a diesel particulate filter 30 (also called a diesel particulate trap). The diesel particulate filter 30 is basically a filter for collecting (i.e., trapping) soot (also called diesel particulate matter) from the exhaust in order to minimize the amount of soot in the exhaust gasses. The vehicle and its components just discussed are known to those skilled in the art and so will not be discussed or shown in more detail herein.

Downstream of the diesel particulate filter 30 is a second intermediate pipe 32. The second intermediate pipe 32 forks into a main flow portion 34 and a restricted flow portion 36. The second intermediate pipe 32 may be a separate component or, alternatively, may be integral with the diesel particulate filter 30 or a muffler 38 (discussed below), if so desired.

A particulate filter backpressure valve 40 is mounted in the main flow portion 34. The backpressure valve 40 may be, for example, a butterfly type valve, with a valve plate 42 mounted on a control shaft 44 that can be rotated by an electronically controlled valve actuator 46. The valve actuator 46 is controlled by a controller 48. While a butterfly-type valve is employed in this embodiment for the backpressure valve 40, other types of automatically controlled valves may be employed instead, if so desired. Moreover, other types of valve actuators may be employed instead, such as vacuum (not shown) or pneumatic (not shown), if so desired. The controller 48 may be made up of one or more discrete controllers, and may be formed from various combinations of software and hardware, as is known to those skilled in the art.

A restriction 50 is located in the restricted flow portion 36 of the second intermediate pipe 32. The restriction 50 is a plate that has a single port 52 that is sized to be significantly smaller than the flow area of the restricted flow portion 36 so that backpressure will be generated upstream of this restriction when exhaust flow is directed through the restricted flow portion 36 of the second intermediate pipe 32.

The portions 34, 36 of the second intermediate pipe 32 direct exhaust flow into a first inlet 54 and a second inlet 56, respectively, to the muffler 38. The muffler 38 has an external wall 55, a first internal wall 57 and a second internal wall 59, which divide the interior of the muffler 38 into three chambers—a first chamber 58, a second chamber 60 and a third chamber 62.

The main flow portion 34 directs exhaust through the first inlet 54 into a primary muffler pipe 64, which extends through all three of the chambers 58, 60, 62 to an outlet 66 of the muffler 38. The muffler outlet 66 directs the exhaust flow into a tailpipe 76, which extends to an open downstream end (not shown) where the exhaust gasses are emitted from the vehicle into the atmosphere. The primary muffler pipe 64 includes a first set of perforations 68 located in the first chamber 58 and a second set of perforations 70 located in the second chamber 60. The second set of perforations 70 and the second chamber 60 are primarily sized and shaped to provide optimal noise attenuation during valve open operation (i.e., when the backpressure valve 40 is open so the exhaust flow is generally through the main flow portion 34 into the primary muffler pipe 64).

The restricted flow portion 36 of the second intermediate pipe 32 directs exhaust through the second inlet 56 into a secondary muffler pipe 72, which extends through to the third chamber 62. A return muffler pipe 74 extends from the third chamber 62 to the first chamber 58. The third chamber 62 and first chamber 58 are primarily sized and shaped to provide optimal noise attenuation during valve closed operation (i.e., when the backpressure valve 40 is closed so the exhaust flow is generally through the restriction 50, secondary muffler pipe 72 and return muffler pipe 74, before flowing through the primary muffler pipe 64).

The exhaust system 20 may also include an upstream pressure sensor 80, which is mounted just prior to exhaust gas entry into the diesel particulate filter 30 in order to measure the pressure in the exhaust gas stream just prior to entry into the filter 30. A downstream pressure sensor 82 may be mounted in the exhaust system 20 just after the exhaust exit from the diesel particulate filter 30 in order to measure the pressure in the exhaust gas stream after exit from the filter 30. Both the upstream and downstream pressure sensors 80, 82 are in communication with the controller 48. The controller 48 may also be in communication with various components of the diesel engine 22, as is known to those skilled in the art.

The operation of the diesel exhaust system 20 will now be described. During normal driving operation, the backpressure valve 40 is maintained in the open position (seen in FIGS. 1 and 2). The exhaust gasses flow from the diesel engine 22, through the diesel oxidation converter 26 and through the diesel particulate filter 30. With the backpressure valve 40 in the open position, the exhaust gasses then generally follow a first muffler flow path—indicated by the first flow path arrows 86 in FIG. 2—where the exhaust gasses essentially pass straight through the primary muffler pipe 64 and into the tailpipe 76. This allows for exhaust flow through the muffler 38 with minimal increase in backpressure. The first and second sets of perforations 68, 70 and first and second chambers 58, 60 (particularly the second set of perforations and second chamber) will provide noise attenuation, and can be, for example, tuned to reduce engine harmonic exhaust noise.

Also, during normal driving operation, as exhaust gasses flow through the exhaust system 20, soot is collected in the diesel particulate filter 30. Consequently, over time, the soot begins to build up in the particulate filter 30. At some point, a determination is made that the soot needs to be burned off (i.e., the filter regenerated) in order to avoid clogging the diesel particulate filter 30. The determination of when the regeneration mode will be initiated can be based on one or more of several factors. For example, the controller 48 may keep track of engine run time, vehicle mileage or fuel consumption since the last regeneration process occurred, and initiate the regeneration process after a predetermined amount of engine run time, vehicle mileage or fuel consumption, as the case may be. For another example, the controller 48 may determine the pressure drop across the particulate filter 30 by calculating the difference in measured pressure between the upstream pressure sensor 80 and the downstream pressure sensor 82, with the regeneration process initiated when a predetermined pressure difference across the particulate filter 30 is reached. Or, the controller 48 may employ a soot regeneration algorithm that estimates an amount of soot build-up based upon some combination of two or more of the previous listed factors, or other factors.

When the determination is made that regeneration of the particulate filter 30 is needed, the controller 48 begins the regeneration process. The controller 48 may cause the regeneration process to occur by actuating the backpressure valve 40, changing the engine operation to include a small amount of extra fuel being injected late in the combustion cycle, or a combination of the two. The particular actions taken by the controller 48 may depend upon the engine and vehicle operating conditions as well as the ambient conditions. The particulate filter backpressure valve 40 is preferably only actuated when engine, vehicle operating, and ambient conditions make reaching the regeneration temperature in the particulate filter 30 difficult—for example, during engine idle or low speed/load operations, and cold ambient temperatures, or when desirable to minimize tailpipe exhaust gas exit temperatures. However, the backpressure valve 40 can be actuated under other conditions, if deemed appropriate for improving the regeneration process.

A second mode of operation occurs when regeneration is needed and it is desirable to close the backpressure valve 40 to accomplish the regeneration. When the backpressure valve 40 closed, the exhaust gasses generally follow a second muffler flow path—indicated by the second flow path arrows 88 in FIG. 3—where the exhaust gasses are redirected through the port 52 of the restriction 50, the secondary muffler pipe 72, the third chamber 62, the return muffler pipe 74, the first chamber 58, and into the primary muffler pipe 64 via the first set of perforations 68. The exhaust gasses then flow through the primary muffler pipe 64 and into the tailpipe 76.

The restriction 50 increases backpressure in the diesel particulate filter 30, which raises the temperature of the exhaust sufficiently to cause regeneration to occur. The restriction 50 also creates a thermodynamic expansion as the exhaust gasses pass through the restriction into the secondary muffler pipe 72, which reduces the temperature of the exhaust gasses downstream of the restriction 50. In addition, the large amount of surface area of the muffler 38 through which the diverted exhaust gasses will travel allows for additional heat transfer out of the exhaust gasses.

The valve closure is continued by the controller 48 until the desired amount of regeneration is achieved or until the controller 48 determines that it is no longer advantageous to hold the valve 40 closed. This may be based, for example, on a predetermined pressure drop across the particulate filter 30 being achieved, a predetermined length of regeneration time, a soot regeneration algorithm that estimates the amount of soot burn-off achieved, or changing engine operating conditions where high exhaust restriction is no longer advantageous. Having achieved the desired regeneration in the particulate filter 30, or appropriate change in engine operating conditions, the controller 48 will actuate the backpressure valve 40 to its open position. The controller 48 will then begin the process over again.

Figure 4:
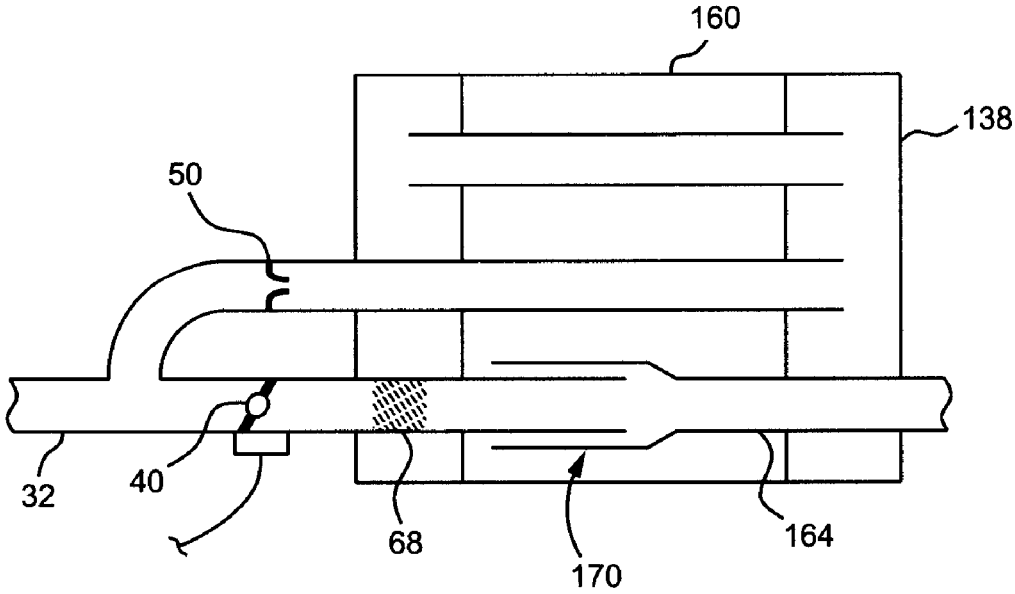
FIG. 4 is a schematic view, similar to FIG. 3, but illustrating a second embodiment of the present invention.

FIG. 4 illustrates a second embodiment of the present invention, where elements that are the same as the first embodiment have been designated with the same numbers, and changed elements have 100-series element numbers. In this embodiment, the primary muffler pipe 164 includes a concentric Helmholtz tuner 170 located in the second chamber 160 of the muffler 138, rather than the second set of perforations. This Helmholtz tuner 170 is optimally tuned to attenuate exhaust noise during the normal mode of operation.

Figure 5:
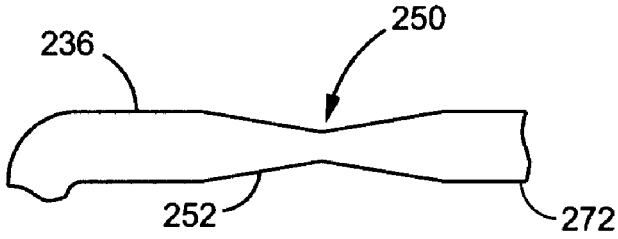
FIG. 5 is a schematic view of a restriction portion of a pipe connecting with a muffler according to a third embodiment of the present invention.

Other variations can be made to the embodiment of FIGS. 1-3, while still providing some or all of the disclosed advantages. For example, the restriction employed to create backpressure with the valve closed can take different forms. FIG. 5 illustrates a third embodiment of the present invention, where changed elements have 200-series element numbers. This embodiment is similar to the first and second embodiments, but has a different type of backpressure restriction. The restriction 250 in the restricted flow portion 236 has a generally conical shaped, tapered-down section 252 that then tapers radially outward as it extends downstream to join with the secondary muffler pipe 272.

Figure 6:
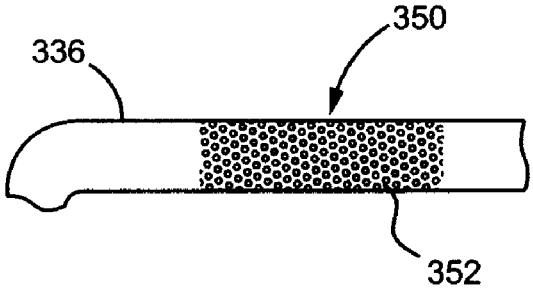
FIG. 6 is a schematic view, similar to FIG. 5, but illustrating a fourth embodiment of the present invention.

FIG. 6 illustrates a fourth embodiment of the present invention, where changed elements have 300-series element numbers. This embodiment is similar to the first and second embodiments, but has another type of backpressure restriction. The restriction 350 in the restricted flow portion 336 is a porous member 352 that fills the portion 336, restricting the exhaust flow through this porous material.

Figure 7:
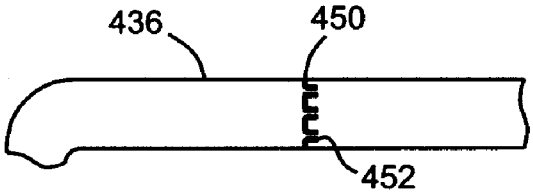
FIG. 7 is a schematic view, similar to FIG. 5, but illustrating a fifth embodiment of the present invention.

FIG. 7 illustrates a fifth embodiment of the present invention, where changed elements have 400-series element numbers. This embodiment is similar to the first and second embodiments, but is another example of a backpressure restriction. The restriction 450 in the restricted flow portion 436 is similar to the plate and single port in the first embodiment, but comprises multiple smaller ports 452 for restricting the flow.

While certain embodiments of the present invention have been described in detail, those familiar with the art to which this invention relates will recognize various alternative designs and embodiments for practicing the invention as defined by the following claims.

What is claimed:

1. An exhaust system for a vehicle having a diesel engine comprising:

a diesel particulate filter having an upstream end for receiving exhaust gasses and a downstream end for exiting the exhaust gasses;

an intermediate pipe, operatively engaging the downstream end of the diesel particulate filter, having a main flow portion and a restricted flow portion, with the main flow portion including a particulate filter backpressure valve controllable to selectively restrict flow of the exhaust gasses in the main flow portion, and the restricted flow portion including a restriction; and a muffler, operatively engaging the intermediate pipe for selectively receiving the flow of the exhaust gasses from the main flow portion and the restricted flow portion, wherein the muffler includes a first chamber, a second chamber, a third chamber, a primary flow pipe extending through the first, second and third chambers to an outlet from the muffler, a secondary muffler pipe extending from the restricted flow portion to the third chamber, and a return muffler pipe extending from the third chamber to the first chamber, and the primary flow pipe includes a set of perforations located within the first chamber.

2. The exhaust system of claim 1 wherein the muffler includes a first exhaust flow path and a second exhaust flow path, and the particulate filter backpressure valve in an open position allows for the flow of the exhaust gasses through the first exhaust flow path, and the particulate filter backpressure valve in a closed position directs the flow of the exhaust gasses through the restriction and the second exhaust flow path.

3. The exhaust system of claim 1 wherein the primary flow pipe includes a set of perforations located wherein the second chamber.

4. The exhaust system of claim 1 including a controller operatively engaging the particulate filter backpressure valve for selectively causing the restriction in the flow of the exhaust gasses through the main flow portion.

5. The exhaust system of claim 4 including an upstream pressure sensor located adjacent to the upstream end of the diesel particulate filter and operable to measure an upstream pressure in the exhaust gasses, and a downstream pressure sensor located adjacent to the downstream end of the diesel particulate filter and operable to measure a downstream pressure in the exhaust gasses, with the upstream and downstream pressure sensors in communication with the controller.

6. The exhaust system of claim 1 wherein the restriction is a plate extending across the restricted flow portion and including a single port extending through the plate.

7. The exhaust system of claim 1 wherein the restriction is a plate extending across the restricted flow portion and including a plurality of ports extending through the plate.

8. The exhaust system of claim 1 wherein the restriction is a radially narrowing, generally conical section of the restricted flow portion.

9. The exhaust system of claim 1 wherein the restriction is a porous member enclosed within the restricted flow portion.

10. The exhaust system of claim 1 wherein the primary flow pipe includes a Helmholtz tuner located within the second chamber.

11. The exhaust system of claim 1 wherein the particulate filter backpressure valve is a butterfly valve.

12. A muffler and pipe assembly for a vehicle having a diesel engine comprising:

an intermediate pipe having a main flow portion and a restricted flow portion, with the main flow portion including a particulate filter backpressure valve controllable to selectively restrict flow of exhaust gasses in the main flow portion, and the restricted flow portion including a restriction; and a muffler, operatively engaging the intermediate pipe, including a first exhaust flow path and a second exhaust flow path, wherein the particulate filter backpressure valve in an open position allows for the flow of the exhaust gasses through the first exhaust flow path, and the particulate filter backpressure valve in a closed position directs the flow of the exhaust gasses through the restriction and the second exhaust flow path, wherein the muffler includes a first chamber, a second chamber, a third chamber, and a primary flow nine extending from the main flow portion through the first, second and third chambers to an outlet from the muffler, and wherein the muffler includes a secondary muffler pipe extending from the restricted flow portion to the third chamber and a return muffler pipe extending from the third chamber to the first chamber, and the primary flow pipe includes a set of perforations located within the first chamber.

13. The assembly of claim 12 wherein the primary flow pipe includes a set of perforations located within the second chamber.

14. The assembly of claim 12 wherein the primary flow pipe includes a Helmholtz tuner located within the second chamber.

15. The assembly of claim 12 wherein the restriction is a plate extending across the restricted flow portion and including a single port extending through the plate.

16. A method of regenerating a diesel particulate filter in an exhaust system of a vehicle having a diesel engine, the method comprising the steps of:

(a) operating the diesel engine and exhaust system in a normal operating mode;

(b) maintaining an open particulate filter backpressure valve during normal operating mode to allow a flow of exhaust gasses through a first exhaust flow path of a muffler;

(c) monitoring at least one parameter indicative of particulate matter build-up in the diesel particulate filter while operating in the normal operating mode;

(d) determining from the at least one parameter when the diesel particulate filter needs regeneration;

(e) detecting that an exhaust backpressure is needed to induce the regeneration of the diesel particulate filter; and (f) operating the exhaust system in a regeneration mode, if the diesel particulate filter needs regeneration and the exhaust backpressure is needed to induce the regeneration of the diesel particulate filter, by closing the particulate filter backpressure valve to redirect the flow of the exhaust gasses through a second flow path of the muffler that includes a flow restriction, wherein the muffler includes a first chamber, a second chamber, a third chamber, a primary flow pipe extending through the first, second and third chambers to an outlet from the muffler, a secondary muffler pipe extending from the flow restriction to the third chamber, and a return muffler pipe extending from third chamber to the first chamber, and the primary flow pipe includes a set of perforations located within the first chamber.

17. The method of claim 16 wherein step (b) is further defined by the first exhaust flow path including the flow of the exhaust gasses through the primary flow pipe.

* * * * *